United States Patent [19]

Brown

[11] Patent Number: 4,818,138

[45] Date of Patent: Apr. 4, 1989

[54] HIGHWAY MARKER

[76] Inventor: Donald M. Brown, Professional Tower, Suite 800, Odessa, Tex. 79761

[21] Appl. No.: 136,357

[22] Filed: Dec. 22, 1987

[51] Int. Cl.[4] ..... E01F 9/00

[52] U.S. Cl. ..... 404/14; 116/63 R; 116/63 T

[58] Field of Search ..... 404/9, 12, 14–16; 116/63 R, 63 T; 350/97, 100, 102, 103; D10/113

[56] References Cited

U.S. PATENT DOCUMENTS

| | | | |
|---|---|---|---|
| D. 181,753 | 12/1957 | Scanland et al. | 404/9 X |
| 1,574,738 | 2/1926 | Cretney | 404/15 |
| 3,319,542 | 5/1967 | Bergsnov-Hansen | 404/16 |
| 3,332,327 | 7/1967 | Heenan | 404/16 |
| 3,334,554 | 8/1967 | Adams | 404/12 X |
| 3,355,999 | 12/1967 | Rusling | 404/12 |
| 3,768,383 | 10/1973 | Tucker | 116/63 |
| 3,920,346 | 11/1975 | Wyckoff | 404/14 |
| 3,936,208 | 2/1976 | Baynes et al. | 404/16 |
| 3,965,596 | 6/1976 | Schrocksnadel | 40/125 |
| 4,040,760 | 8/1977 | Wyckoff | 404/14 |
| 4,069,281 | 1/1978 | Eigenmann | 264/1 |
| 4,076,383 | 2/1978 | Heasley | 350/103 |
| 4,236,788 | 12/1980 | Wyckoff | 350/97 |
| 4,340,319 | 7/1982 | Johnson, Jr. et al. | 404/16 |
| 4,577,992 | 3/1986 | Jefferies | 404/16 |
| 4,687,369 | 8/1987 | McDonald | 404/12 |

*Primary Examiner*—Stephen J. Novosad
*Assistant Examiner*—John F. Letchford
*Attorney, Agent, or Firm*—Marcus L. Bates

[57] ABSTRACT

A highway marker for attachment to a roadbed to signal the location of a lane extending longitudinally of the roadbed and to signal the proper direction of movement in a traffic lane while defining the boundaries of the traffic lane. The marker has a bottom surface for attachment to a roadbed, a base and adjacent sides are perpendicularly arranged to the base and describe the boundaries of a triangle. A triangular floor in the form of a triangle has a base coincident with the perpendicular base and sides spaced inwardly from the perpendicular sides with there being a peeked boundary formed between the perpendicular adjacent sides and the adjacent sides of the floor. A reflective surface on the perpendicular adjacent sides form an arrow indicating a direction of travel while another reflective surface on the floor indicates an opposite direction of travel respective to the first arrow and can be of various colors.

15 Claims, 2 Drawing Sheets

HIGHWAY MARKER

BACKGROUND OF THE DISCLOSURE

Highway markers of the reflector type are well known as evidenced by the following U.S. Pat. Nos. 3,319,542 to Bergsnov-Hansen; 3,332,327 to Heenan; 3,334,554 to Adams; 3,768,383 to Tucker; 3,920,346 to Wyckoff; 3,936,208 to Baynes et al; 3,965,596 to Schrocksnadel; 4,040,760 to Wyckoff; 4,069.281 to Eigenmann; 4,076,383 to Heasely; 4,236,788 to Wyckoff; 4,340,319 to Johnson, Jr. et al; 4,577,992 to Jefferies.

The reflector of the present disclosure has an outer layer of clear plastic material covering a reflective surface as taught in Heanan U.S. Pat. No. 3,332,327, for example. Tucker, U.S. Pat. No. 3,768,383, FIGS. 14 and 15 shown one concept of a single reflector that indicates arrows oppositely arranged and discusses the problems associated with wrong way driving. Baynes et al U.S. Pat. No. 3,936,208; and Heasley, U.S. Pat. No. 4,076,383 show multi-sided retroflective bodies having opposed reflective surfaces and the details of construction thereof, to which reference is made for still further background of this disclosure.

The present invention describes a highway marker for signaling direction of movement of a traveling vehicle and for delineating boundaries of traffic lanes. The highway marker is attached to a roadbed and has reflective surfaces that form a signal acknowledging that a person is driving in the proper direction along a roadway, while simultaneously signaling to another person that he is traveling in the wrong direction down the roadway should the other person be traveling in the opposite direction to the proper flow of traffic.

SUMMARY OF THE INVENTION

A highway marker for signaling direction of movement of traffic, while delineating the boundaries of traffic lanes. The highway marker of the present invention has an outer surface that forms two different arrows; one arrow assures the driver of a traveling vehicle that he is traveling in the proper lane in the proper direction while at the same time a plurality of the markers delineate the boundaries of the lane. The other arrow warns a driver traveling in the opposite direction that he is going the wrong way and at the same time delineates the boundaries of the lane in which he should not be traveling.

The marker of this disclosure has a bottom surface or underside treated for enhancing its attachment to the surface of a roadway. The marker is in the form of a triangle having a base and adjacent sides which are arranged perpendicularly respective to the bottom and which describe the boundaries of the reflector.

A smaller triangle is enclosed within the first triangle and has a base that coincides with the base of the first triangle. The small triangle is not quite congruent with the first triangle and the small triangle forms a sloped floor within the reflector that drains liquid rearwardly so that it does not accumulate and freeze.

Between the adjacent sides of the sloped floor and the adjacent sides of the reflector is a tetrahedron having a base that coincides with the base of each triangle of the reflector. The tetrahedron has opposed surfaces, one of which augments one of the arrows, the other of which augments the other arrow.

The tetrahedron overlies the perpendicular adjacent sides of the reflector and forms a peaked boundary between the floor and the perpendicular adjacent sidewalls. The apex of the tetrahedron, floor, and adjacent sides, lies along a longitudinal centerline of the reflector apparatus. The two tetrahedrons intersect one another at the apex.

Accordingly, all of the surfaces of the reflector slope inwardly, outwardly, or rearwardly so that the reflector device is self draining and will not accumulate appreciable moisture. To some extent these features make the reflector self cleaning.

Accordingly, a primary object of the present invention is the provision of a reflector of unitary construction having a plurality of surfaces arranged in such a manner that the boundary of a roadway is delineated, while at the same time, a signal is provided which indicates that an automobile is traveling in the proper direction and another signal which indicates that an automobile is traveling in the wrong direction.

Another object of the invention is to provide a reflector device for marking a lane of a roadway which has a plurality of surfaces arranged to self drain the reflector so that water cannot accumulate thereon, and wherein the surfaces are arranged to provide a warning to motorist traveling in the wrong direction, while at the same time there is another signal indicating to the motorist traveling in the proper direction that he is in the proper lane.

A further object of this invention is the provision of a reflector apparatus having a plurality of surfaces arranged in a geometrical pattern that provides a main body that defines an isosceles triangle, within which there is another triangular body in the form of a smaller isosceles triangle, with the adjacent sides of each of the triangles being separated by a tetrahedron, with the adjacent sides of the tetrahedron being a reflective surface, one for signaling traffic traveling in one direction, the other for signaling traffic traveling in the other direction.

An additional object of this invention is the provision of a reflector of unitary construction having a plurality of reflective surfaces formed thereon, and arranged in an unusual manner to present a red arrow indicating that one is traveling in the wrong direction, and a green arrow indicating that one is traveling in the proper direction.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
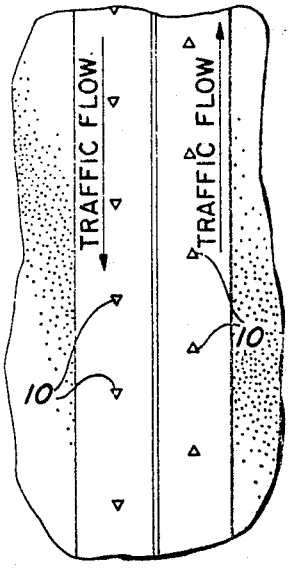
FIG. 1 is a fragmentary, diagrammatical representation of a roadway, with reflectors made in accordance with the present invention shown associated therewith.

In FIG. 1 there is disclosed a roadway, often called a four-lane highway, with there being two lanes of traffic flowing in each direction, with the two lanes each being delineated by a reflector device 10 made in accordance with the present invention. Those skilled in the art will appreciate that there are numerous other applications of the present invention, as for example, taxiways for aircraft.

Figure 2:
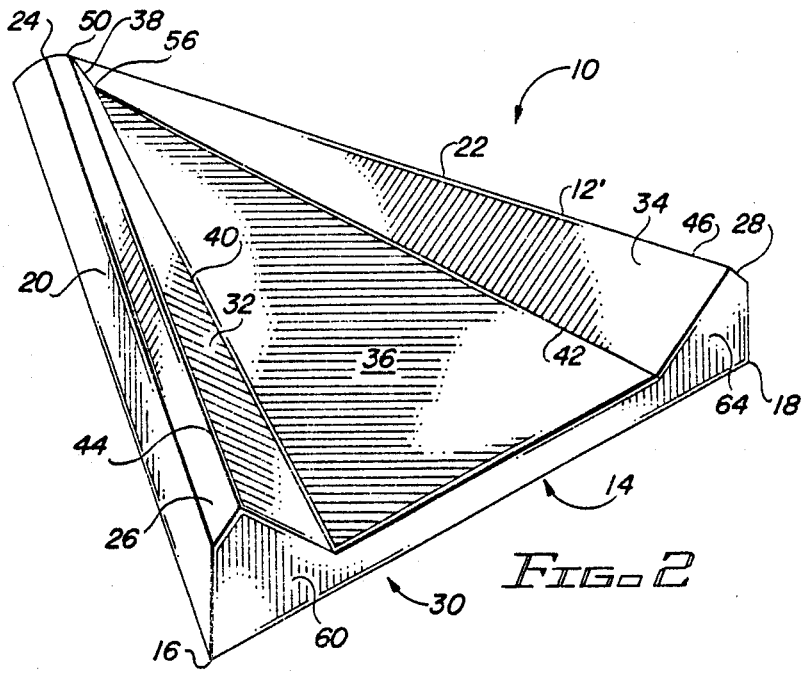
FIG. 2 is an enlarged, detailed, perspective view of a reflector made in accordance with the present invention.
Figure 3:
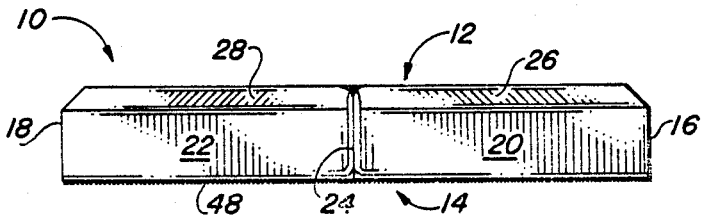
FIG. 3 is a front view of the reflector disclosed in FIG. 2.
Figure 4:
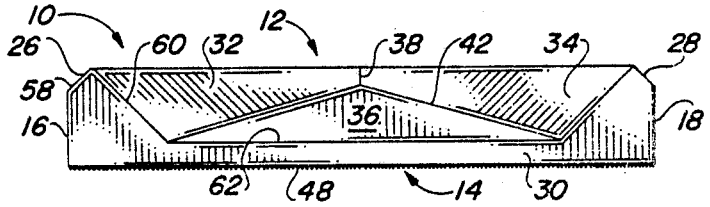
FIG. 4 is a rear view of the reflector seen in FIGS. 2 and 3.

The details of the reflector device 10 are illustrated in FIGS. 2–8, wherein the reflector 10 is seen to have a top or uppermost surface 12 opposed to a bottom or underside 14 thereof. In FIGS. 2–4, the apparatus has opposed corners 16, 18 adjacent sides 20, 22 that diverge toward one another into a rounded nose at apex 24. The sides 20, 22 are perpendicular to the bottom and have an upper edge portion joined to the upper angled surface 26 and 28.

Figure 6:
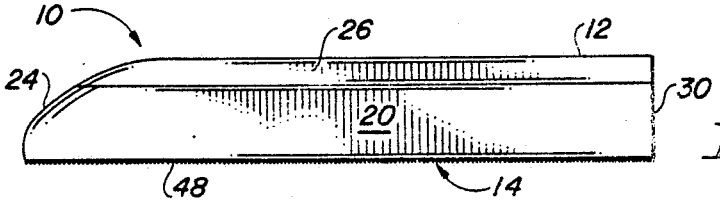
FIG. 6 is a side elevational view of the reflector disclosed in the foregoing figures.

In FIGS. 2, 4 and 6, base 30 of the reflector forms a rear wall which also is perpendicular respective to bottom 14. Inwardly sloped walls 32 and 34 downwardly slope towards a floor 36. The surfaces 32, 34 are joined along edge 38 at apex 50, 56 to form an acute angle therebetween.

Numeral 40 indicates the edge where surfaces 32, 36 are joined together; numeral 42 indicates the edge where surfaces 34, 36 are joined together; numeral 44 indicates an edge where surfaces 26, 32 are joined together; and numeral 46 indicates an edge where surfaces 28, 34 are joined together. Edges 40, 42 converge towards one another and are joined at the apex 56. Edges 44, 46 converge towards one another and meet at apex 50.

The bottom 14 is provided with a surface 48 that is roughened to have a texture and appearance similar to a sandy surface. The roughened surface enhances the bond that must be effected between the bottom 14 and a roadway in order to successfully use the present invention to its full advantage.

Figure 7:
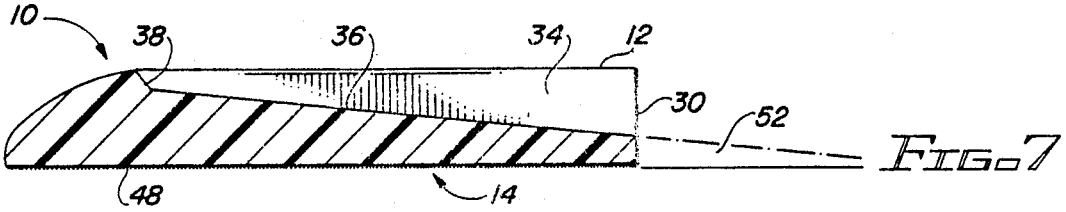
FIG. 7 is a cross-sectional view taken along line 7—7 of FIG. 5.
Figure 5:
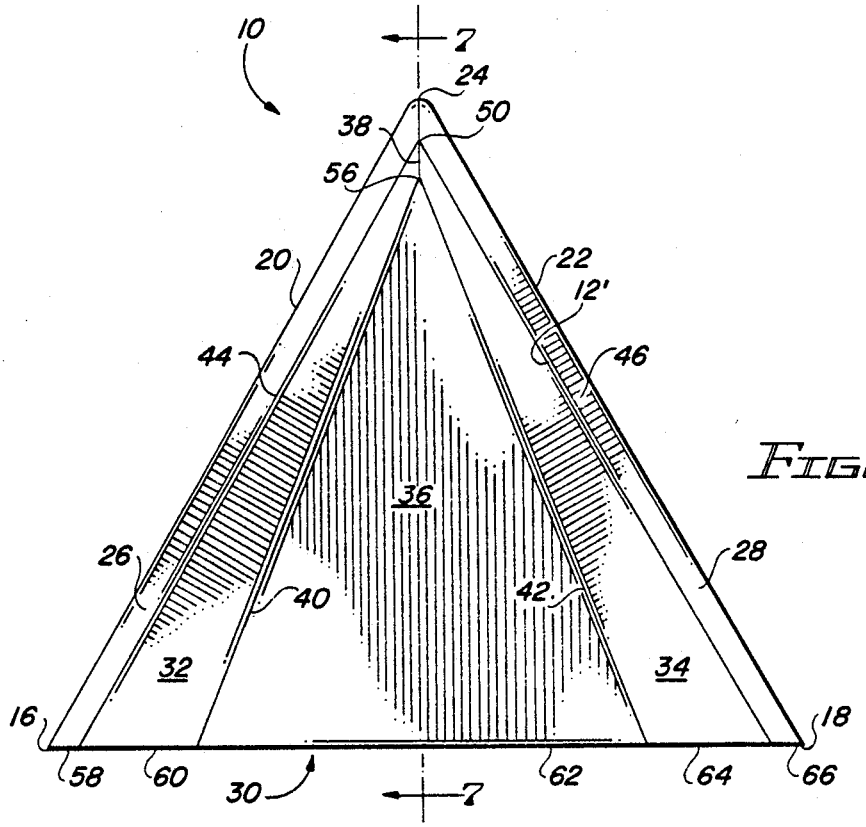
FIG. 5 is a top plan view of the reflector disclosed in the foregoing figures.
Figure 8:
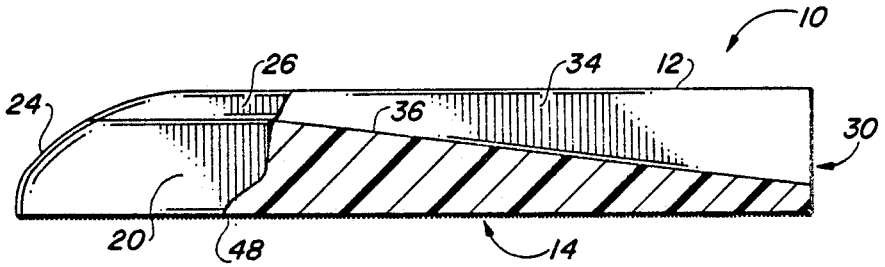
FIG. 8 is a side view similar to FIG. 6, with some parts being broken away therefrom and some of the remaining parts being shown in cross-section.

In FIG. 7, numeral 52 indicates the angle of the slope of floor 36. The angle preferably is 4–8 degrees. In FIG. 5, the longitudinal centerline lies along numerals 7—7. Numerals 58–66 indicate the dimensions of various surfaces, wherein 58 and 66 are the horizontal width of surface 26, 28; numeral 60, 64 is the horizontal width of surfaces 26, 32:28, 34; and , numeral 62 indicates the width of the base of the triangular floor 36. The actual size and dimensions can be changed as desired but preferably are about as hereinafter set forth.

In the drawings, the floor 36 is seen to be an isosceles triangle having adjacent sides 40, 42 and a base at 30. The base 30 coincides with the base of the large isosceles triangle formed by the reflector device and specifically by adjacent sides 20, 22 connected to base 14 at corners 16, 18.

The surfaces 20, 22 and 26, 28, preferably are a reflector that reflects red light to the driver of an oncoming vehicle traveling in the wrong lane of a roadway. The surfaces 32, 34 preferably are green or blue to indicate that a vehicle is traveling in the proper direction. The floor 36 can be made white. Alternatively, surfaces 32, 34 can be made white while surface 36 can be made green or blue, indicating proper direction of travel down the lane of a roadway.

In some instances it is desirable to utilize reflected light that is amber in color. This is best achieved by utilizing reflected light of an amber color from base 30 of the reflector.

It will be noted that the marker or reflector 10 is in the form of a triangle, there being a base 30 connected to adjacent sides 20,22. These wall surfaces are arranged perpendicular to bottom 14 of the reflector and describe the triangular shaped reflector.

In the preferred embodiment of the invention, the reflector is a unitary body in the form of an isosceles triangle having a base 30 three inches wide, equal sides 20, 22 which are four inches long, and an altitude (at 7—7) of five inches. The height of the sloping floor 36 above bottom 14 is one-half inch at the base 30 and slopes upward towards the apex 50. The height of the tetrahedron is one inch above the bottom 14. The nose at apex 50 is rounded at 24 to prevent injury to the pneumatic tires of the traveling vehicles.

Surfaces 32 and 26 together with base 60 form a tetrahedron which lies above the adjacent side 20. Similarly, sides 34, 28 together with base 64 form a tetrahedron on the side opposite. The tetrahedrons are relatively wide at the base 60, 64 and include an imaginary fourth side (not shown) which is defined by two different imaginary planes passing through the edges 40, 42 of the surfaces 32, 34, and through the outer edges of surfaces 26, 28.

The arrow safety marker of this invention preferably is fabricated from high impact plastic material that exhibits properties that will withstand heavy traffic over a long period of time. The reflective surface of the marker is made in accordance with the U.S. Pat. No. 3,332,327 to Heenan; and this reference is incorporated herein to provide additional details of design. Heenan is especially relied upon with respect to the configuration of the outer surface thereof, and the teaching of a light receiving and refracting face and an inner surface having a reverse light receiving and reflecting face.

An unusual and unexpected feature derived from the use of the present invention is the ability of the reflector to accommodate several road resurfacing or seal coats without the necessity of removing and subsequently replacing the reflector to avoid burying the apparatus. The sidewalls of the reflector can be made of a height which is adequate to endure several rejuvenations of a road surface.

I claim:

1. A highway marker for attachment to a roadbed to signal the location of a lane extending longitudinally of the roadbed and to signal the proper direction of movement in a traffic lane while defining the boundaries of the traffic lane;

said marker has a bottom surface for attachment to a roadbed, and surfaces forming a base and adjacent sides that are perpendicularly arranged respective to the bottom surface and describe the boundaries of a triangle;

a triangular floor in the form of a triangle which is smaller than the first recited triangle and has an edge forming a base that is coincident with the perpendicular base, and edges spaced inwardly from the perpendicular sides; with there being a peaked boundary formed between the perpendicular adjacent sides and the edges of the floor; said triangular floor and the triangular bottom surface each having an apex;

means forming a reflective surface on said perpendicular adjacent sides which jointly form an arrow indicating a direction of travel;

means forming a reflective surface on said floor indicating a direction of travel separate from the arrow.

2. The marker of claim 1 wherein the perpendicular base and the base of the floor have opposed corners; the apex of the triangular floor and the apex of the perpendicular adjacent sides are spaced apart less than the opposed corners formed at the bases.

3. The marker of claim 1 wherein said floor is an isosceles triangle and is sloped upwardly from said triangular floor base to the floor apex, said floor lies in a plane which is not parallel to the bottom surface.

4. The marker of claim 1 wherein said peaked boundary has narrow surfaces that commence at said perpendicular sides, and wide surfaces that commence at the edges of the floor, the surfaces that form said peaked boundary are joined together along an edge that terminates in a peaked apex.

5. The marker of claim 1 wherein said peaked boundary has narrow surfaces connected at said perpendicular sides, and wide surfaces connected at the floor, said peaked boundary defines a pair of tetrahedrons that extend above said adjacent sides each tetrahedron having a base coincident with the base of the marker and an apex that terminates near the floor apex.

6. A marker for attachment to a roadbed to signal the location of a traffic lane extending longitudinally of the roadbed and to signal the proper direction of movement of traffic in a traffic lane;

said marker has a bottom surface, a base, and adjacent sides; said adjacent sides and said base are substantially perpendicularly arranged respective to the bottom and describe the boundaries of the marker;

a floor in the form of a triangle which has a base parallel to the perpendicular base, and edges spaced inwardly from said adjacent sides with there being a boundary formed between the adjacent sides and the edges of the floor;

means forming a reflective surface on the perpendicular adjacent sides that form an arrow indicating a direction of travel; and, means forming a reflective surface on said floor indicating another direction of travel.

7. The marker of claim 6 wherein the edges of the triangular floor terminate in an apex and form spaced opposed angles with said triangular floor base; and the perpendicular adjacent sides terminate in an apex and spaced opposed corners at said marker base; the apexes being spaced apart less than either the opposed angles or the opposed corners.

8. The marker of claim 6 wherein said floor has an apex and is in the form of an isosceles triangle which is sloped from said floor base to said floor apex, and said marker having an overall configuration that is in the form of a triangle.

9. The marker of claim 8 wherein said boundary is in the form of a pair of tetrahedrons; each said tetrahedron having a narrow surface that commences at one of said perpendicular sides, and a wide surface that commences at one of said floor edges, the narrow and the wide surfaces of each said tetrahedron being joined together along an edge to form said boundary; the edges of said tetrahedrons intersecting at an apex which is spaced from the apex of said floor.

10. The marker of claim 6 wherein said boundary has narrow surfaces that commence at said perpendicular surfaces, and wide surfaces that commence at the edges of said floor, said boundary defines a pair of tetrahedrons each having a base coincident with the base of the marker; said tetrahedrons being joined at an apex that terminates above the floor apex.

11. A highway marker for attachment to a roadbed to signal the boundaries of a lane extending longitudinally of the roadbed and to signal the proper direction of movement in a traffic lane;

said marker has an underside for support from a roadbed, a base and adjacent sides are perpendicularly arranged respective to the underside, said base and said adjacent sides describe the boundaries of a triangle and of the marker; said underside having an apex;

means forming a reflective surface on the perpendicular adjacent sides which jointly form an arrow indicating a direction of travel;

said highway marker has a centrally located triangular floor which is smaller than the first recited triangle and has a base arranged parallel respective to the perpendicular base, and an apex, and adjacent edges spaced inwardly from the perpendicular sides; a boundary is formed between the perpendicular adjacent sides and the adjacent edges of the floor; said boundary extends above said adjacent sides and forms a reflective surface oriented in the same direction respective to the orientation of the reflective surface of the adjacent sides; the perpendicular adjacent sides form an apex;

wherein said floor is in the form of an isosoceles triangle which is sloped from said floor base to said floor apex, means forming a reflective surface on said floor indicating a direction of travel separate from the arrow;

opposed corners join the marker base to the adjacent sides, opposed corners join the adjacent edges of the floor to the base of the floor; the apex of the triangular floor and the apex of the perpendicular adjacent sides are spaced apart less than the opposed corners of the bases of the adjacent sides and floor;

said floor lies in a plane which forms an acute angle respective to the underside.

12. The marker of claim 11 wherein said boundary has narrow surfaces connected at said perpendicular sides, and wide surfaces connected at said floor edges which define a pair of tetrahedrons that extend above said adjacent sides each said tetrahedron having a base coincident with the base of the marker and said tetrahedrons intersecting one another along an edge that lies between the underside apex and the floor apex.

13. The marker of claim 11 wherein the apex of the triangular floor and the apex of the perpendicular adjacent sides are spaced apart by said boundary.

14. The marker of claim 11 wherein said floor is in the form of an isosceles triangle which is sloped from the floor base to the floor apex.

15. The marker of claim 11 wherein said boundary is in the form of a pair of tetrahedrons; each said tetrahedron having a narrow surface that commences at one of said perpendicular sides, and a wide surface that commences at one of said floor edges, the narrow and the wide surfaces being joined together to form said boundary; said tetrahedrons intersecting at an apex.

* * * * *